United States Patent [19]

Shoji et al.

[11] Patent Number: 4,961,518

[45] Date of Patent: Oct. 9, 1990

[54] CARTRIDGE CONTAINER

[75] Inventors: Iwao Shoji, Shibata; Masataka Okushita, Tokyo, both of Japan

[73] Assignee: Dai Nippon Insatsu Kabushiki Kaisha, Japan

[21] Appl. No.: 496,073

[22] Filed: Mar. 14, 1990

Related U.S. Application Data

[63] Continuation-in-part of Ser. No. 238,111, Aug. 30, 1988, abandoned.

[30] Foreign Application Priority Data

Sep. 2, 1987 [JP] Japan ..... 62-219626

[51] Int. Cl.[5] ..... B65D 35/08

[52] U.S. Cl. ..... 222/107; 222/325; 222/386.5

[58] Field of Search ..... 222/92, 95, 106, 107, 222/183, 325, 335, 386.5, 185, 215

[56] References Cited

U.S. PATENT DOCUMENTS 1,575,567 3/1926 Geake ..... 222/92
2,950,029 8/1960 Winstead ..... 222/143
3,042,271 7/1962 Winstead ..... 222/183 X
3,233,411 2/1966 Schubert ..... 222/386.5 X
4,236,516 12/1980 Nilson ..... 222/95 X

*Primary Examiner*—H. Grant Skaggs
*Assistant Examiner*—David H. Bollinger
*Attorney, Agent, or Firm*—Arnold, White & Durkee

[57] ABSTRACT

A cartridge container of the character to be mounted in an office machine into and from which a viscous fluid such as ink is supplied and sucked out, comprises: a lower half container section made of a rigid material and an upper half container section made of a pliant sheet material, both sections being bonded along their opening edges and communicating with each other internally when both sections are thermally bonded. The upper half container section has a shape or dimensions to be substantially entirely foldable into the interior of the lower half container section in a reversely turned-over condition so as to closely oppose the inner wall of the lower half container section when the viscous fluid in the cartridge container is substantially entirely sucked out therefrom through a spout disposed at the lower portion of the lower half container section.

7 Claims, 3 Drawing Sheets

CARTRIDGE CONTAINER

This is a Continuation-In-Part of application Ser. No. 07/238,111 filed Aug. 30, 1988 now abandoned.

BACKGROUND OF THE INVENTION

This invention relates to a cartridge container to be mounted in an office machine, for example, such as an office printing machine, a copying machine or the like with a viscous fluid such as ink filled therein for supply to the office machine. The cartridge container can be utilized for other machines or devices of this character for supplying viscous fluid other than ink.

A conventional technique employs a bag made of a pliant material, which is mounted in an office machine such as an office printing or copying machine having an ink charged condition. The ink filled in the bag is sucked out by means of a plunger pump, for example, through a sucking spout provided on the bag to be supplied to the necessary portion of the office machine.

As described, when such a pliant bag is used as an inking bag, it is accommodated in a box to be mounted in the office machine to form a so-called bag-in-box package The ink in the bag is sucked out from within the bag by actuating a plunger pump, for example, through a sucking spout.

In this case, since the bag is entirely made of pliant material, it is shrunk and deformed entirely irregularly in the box as the ink is sucked out through the sucking spout, so that it is difficult to completely use up the ink filled in the bag.

SUMMARY OF THE INVENTION

Accordingly, an object of this invention is to eliminate the drawbacks or defects of the prior art and to provide a cartridge container from which a viscous fluid can be sucked out and which enables substantially complete using of the viscous fluid in the cartridge container and can be easily manufactured and handled.

This and other objects can be achieved according to this invention by providing a cartridge container into and from which a viscous fluid is supplied and sucked out, the container being characterized by comprising: a lower half container section made of a rigid material and having an upper opening defined by an edge portion, an upper half container section made of a pliant sheet material having a lower opening defined by an edge portion which is bonded to said edge portion of the lower half container section and a spout disposed at a lower portion of the lower half container section through which a viscous fluid is supplied into or sucked out from the cartridge container, the upper half container section having such a shape and dimensions as to be substantially entirely foldable into the interior of the lower half container section in a reversely turned-over condition and as to closely oppose the inner wall of the lower half container section when the viscous fluid in the cartridge container is substantially entirely sucked out therefrom through the spout.

The cartridge container may have a rectangular parallelepiped shape or spherical shape when swelled and may be divided into the lower and upper two sections along a diagonal plane or a horizontal plane thereof.

According to the structure of the cartridge container described above, a viscous fluid such as ink is supplied into the container through the spout. At this time, the pliant upper half container section, which in this state is folded into the lower half container, is swelled, by the supply of the viscous fluid, into a predetermined shape. The viscous fluid is sucked out from the cartridge container, when required to be supplied into a necessary portion of an office machine, for example. During the viscous fluid sucking-out process, the pliant upper half container section is gradually shrunk and deformed into the rigid lower half container section and finally entirely folded thereinto, so that the reversed surface of the upper half container section closely opposes the inner wall of the lower half container section thereby to enable substantially entire sucking out of the viscous fluid.

Preferred embodiments of this invention will be described further in detail hereunder with reference to the accompanying drawings.

DESCRIPTION OF THE PREFERRED EMBODIMENTS

Figure 1:
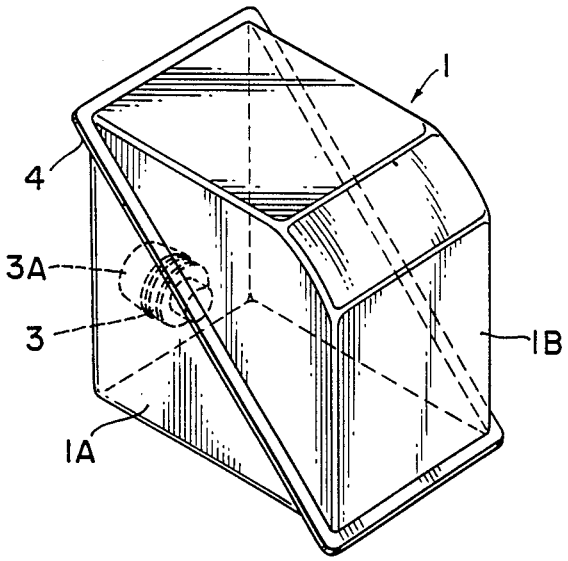
FIG. 1 is a perspective view of a cartridge container in a swelled state according to one embodiment of this invention.

A cartridge container 1 shown in FIG. 1 in perspective view comprises a lower half container section 1A made of a rigid material and an upper half container section 1B made of a pliant sheet material. The illustrated cartridge container 1 has an outer configuration of substantially a rectangular parallelepiped, and the lower and upper container sections 1A and 1B have respective shapes obtained by separating the container 1 along a diagonal plane as shown in FIG. 1 or FIG. 2.

The lower half container section 1A is made of a hard material (having a rigidity for keeping its shape in case a certain pressure is applied thereto) such as polyethylene resin, vinyl chloride resin, polypropylene resin, polystyrene resin or like material. The upper half container section 1B is made of a pliant material such as polyethylene-nylon-polyethylene laminated material or the like pliant synthetic resin material which is thermally fusible to be bonded to the lower half container section 1A.

Figure 2:
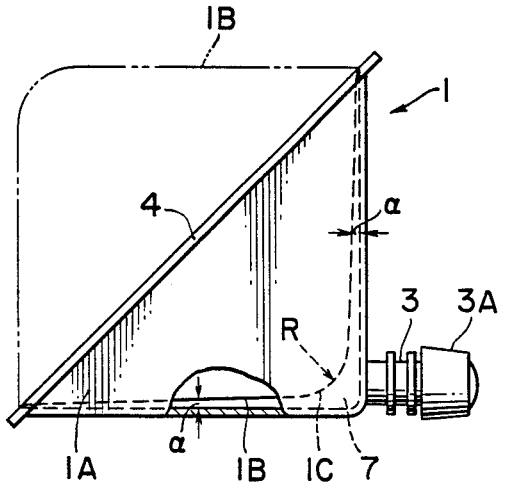
FIG. 2 is a side view of the cartridge container shown in FIG. 1, in which an upper half container section is folded into a lower half container section.

The lower half container section 1A, as shown in FIG. 2, is provided with a dispensing spout 3 through which a viscous fluid is supplied or dispensed, at a lower portion of the rectangular side wall of the section 1A. The spout 3 has a cap 3A applied thereto for open or closing the same. The lower half container section 1A is provided with a slanted upper opening having an upper edge formed by a rectangular flange 4.

Figure 3:
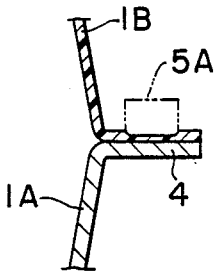
FIGS. 3 and 4 are fragmental sectional views both showing a manner of bonding of the lower and upper container sections of the cartridge container.
Figure 4:
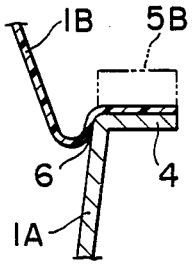

The upper half container section 1B is provided with a slanted lower opening with an edge portion fusingly bonded to the flange 4 of the lower half container section 1A. The bonding of the edge portion of the upper half container section 1B to the flange 4 of the lower half container section 1A is performed to provide a linearly sealed portion in a preferred embodiment by means of a linear heating plate 5A having a width smaller than that of the flange 4, for example as shown in FIG. 3. In the case of when a heating plate 5B, having a width substantially equal to that of the flange 4, is used to fuse and bond the edge portion of the upper half container section lB, as shown in FIG. 4, a portion 6 adjacent to the edge portion is thermally expanded by the application of the heat, and deformed into the inside of the lower half container section lA, which will reduce the inner volume of the cartridge container. Accordingly, it is desirable to use the liner heating plate 5A having a width smaller than that of the flange 4 as shown in FIG. 3.

Figure 5:
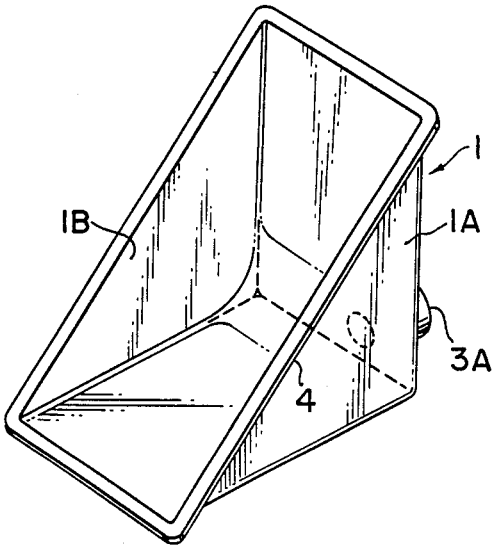
FIG. 5 is a perspective view of the folded state of the cartridge container shown in FIG. 2.
Figure 6:
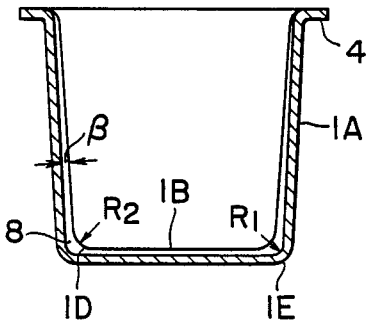
FIG. 6 is an elevational section of the cartridge container shown in FIG. 5.

The cartridge container 1 has an entire shape shown in FIG. 1 when the container 1 is charged with a viscous fluid such as an ink, but when the viscous fluid has been completely sucked out by sucking force, the upper half container section 1B is deformed, because of the flexibility thereof, inwardly of the lower half container section 1A in a reversely turned-over state so as to contact the inner wall surface thereof as shown in FIGS. 2, 5 and 6.

However, when the upper half container section 1B is completely folded into the lower half container section 1A, there exists a small gap therebetween as shown in FIGS. 2 and 6. In this connection, with reference to FIG. 2, the gap has a width gradually increasing from the flange 4 towards the spout 3 with an angle $\alpha$ of up to about 1.5°, which may be made to zero angle in certain cases. In any case, a corner portion 1C of the inwardly folded upper half container section 1B, opposing the spout 3, is constructed to have a relatively large radius of curvature R to thereby define a space 7 between the corner portion 1C and the spout 3. The corner portion 1C is not necessarily round, but may be constructed to have a straight-cut cross section. Further, with reference to FIG. 6, in a preferred illustrated embodiment, the upper and lower container sections 1B and 1A are designed to have a gap therebetween having a width gradually increasing from the flange 4 towards the lower portion of the lower half container section lA with an angle $\beta$ of from about 0° to 2.0° when the upper half container section 1B is inwardly folded. A corner portion 1D of the upper half container section 1B has a round surface having a radius of curvature $R_2$ and a corner portion 1E of the lower half container section 1A has a round surface having a radius of curvature $R_1$ being smaller than the curvature $R_2$ so as to define a space 8 between the upper and lower container sections 1B and 1A. The round surfaces of the corner portions 1D and 1E may be replaced by straight-cut portions as suggested above.

The cartridge container 1, according to this invention described hereinabove is used in the following manner; an ink container to be mounted to an office printing machine being taken as an example for explanation purposes.

The cartridge container 1 is initially in the state shown in FIG. 5 in which the upper half container section 1B is folded into the lower half container section lA. Under the shown state, a high viscous ink is charged into the container 1 through the spout 3 by a suitable known means, not shown, and when the cartridge container 1 has been completely filled with the ink, the container 1 assumes the shape shown in FIG. 1. The ink may be supplied in the cartridge container 1 which is preliminarily wwelled to the full shape by blowing a pressurized air thereinto.

The cartridge container 1 of the state shown in FIG. 1 is accommodated in a box, for example, made of cardboard with the spout 3 projecting outwardly. The box, together with the cartridge container 1, is then mounted to a predetermined portion of the office printing machine. After mounting, the cap 3A is removed from the spout 3 and the ink in the cartridge container 1 is sucked out by means of a plunger pump, for example, and supplied to the necessary portion of the office printing machine through the spout 3.

As the ink in the cartridge container 1 is consumed and sucked out outwardly, the upper half container section 1B, made of pliant material, is gradually shrunk and deformed and finally folded into the rigid lower half container section lA as shown in FIG. 5. During this ink sucking process, since merely the small gap exists between the folded surface of the upper half container section 1B and the inner wall of the lower half container section 1A, substantially the entire ink filled in the cartridge container 1 is sucked out, and the gap assists the application of the sucking force throughout the interior of the cartridge container 1, substantially without the ink remaining in any portion therein. Moreover, the space 7 is formed near the spout 3, so that the ink is collected therein in the final sucking stage and then substantially completely sucked out from the cartridge container 1. The lower edge portion of the upper half container section lB is relatively linearly bonded to the flange of the lower half container section 1A, so that the side portion of the upper half containter section 1B can be smoothly folded into the lower half container section 1A when the ink is sucked out.

As described above, the cartridge container for a viscous fluid comprises: the rigid lower half container section and the pliant upper half made, thus providing the necessary basic configuration thereof when a viscous fluid is filled therein. Since the upper half container section is substantially completely folded into the lower half container section when the fluid sucking force is applied, approximately the entire fluid can be sucked out through the spout.

Figure 7:
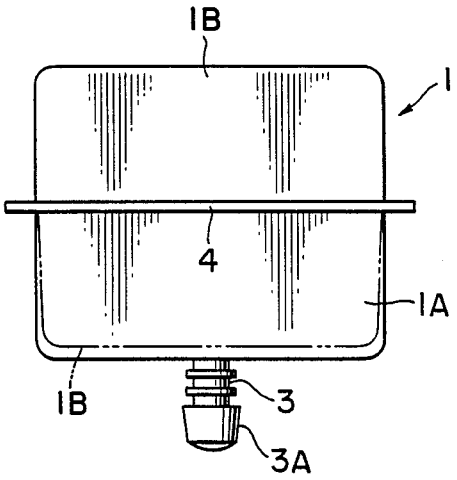
FIGS. 7 and 8 are side views of cartridge containers according to other embodiments of this invention.
Figure 8:
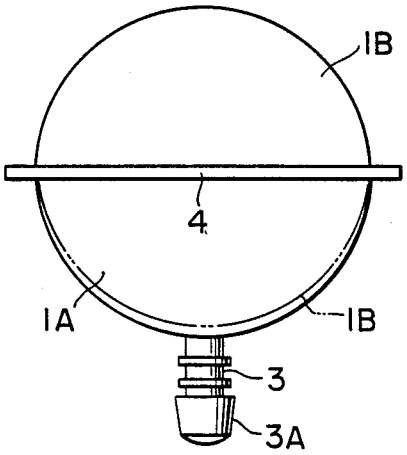

In another embodiment of this invention, a rectangular cartridge container may be constructed by upper and lower halves, separated by a plane parallel to the bottom portion of the cartridge container as shown in FIG. 7. In this embodiment, the spout 3 extends downwards. A spherical cartridge container which is also divided into upper and lower halves may be also used as shown in FIG. 8.

What is claimed is:

1. A rectangular parallelpiped-shaped cartridge container into or from which a viscous fluid consisting of ink is supplied or removed, comprising:

a lower half container section made of a rigid material having an upper opening defined by an edge portion;

an upper half container section made of a pliant sheet material having a lower opening defined by an edge portion which is bonded to the edge portion of said rigid section, said rigid section and said pliant section being bonded along a diagonal plane of the cartridge container, the edge portion of said rigid section being constructed as a flange to which the edge portion of said pliant section is linearly bonded to seal the cartridge container; and a spout disposed at a lower portion of said rigid section through which the viscous fluid is supplied into and removed from the cartridge container;

wherein said pliant section has a shape and is dimensioned to be foldable into an interior of said rigid section in a reversibly turned-over condition so as to closely oppose an inner wall of said rigid section, said pliant section being substantially entirely folded into said rigid section when the viscous fluid is substantially entirely removed therefrom through said spout, said rigid section and said pliant section having shapes and dimensions such that a space is defined between said rigid section and said pliant section which is adjacent said spout when said pliant section is substantially entirely folded into said rigid section.

2. The cartridge container of claim 1, wherein said rigid section and said pliant section are each provided with rectangular corner portions having dimensions such that spaces are defined between opposing corner portions of said rigid section and said pliant section when said pliant section is substantially entirely folded into said rigid section.

3. The cartridge container of claim 1, wherein the flanged portion of said rigid section and the edge portion of said pliant section are thermal bonded by applying a heat plate having a width in cross section larger than that of the flanged portion of said rigid section.

4. The cartridge container of claim 1, wherein a gap is formed between each side wall of said pliant section and said rigid section, when said pliant section is substantially entirely folded into said rigid section, said gap originating at said flange and extending from said flange to said spout, said gap being characterized by an angle of about 0.0°–1.0° which is defined by each said side wall of said pliant section and said rigid section.

5. The cartridge container of claim 1, wherein said pliant section and said rigid section, when said pliant section is substantially entirely folded into said rigid section, possess corner portions each with a radius of curvature which defines said space, wherein the radius of curvature of said rigid corner portion is less than the raidus of curvature of said pliant corner portion.

6. The cartridge container of claim 1, wherein a gap is formed between each side wall of said pliant section and said rigid section, when said pliant section is substantially entirely folded into said rigid section, said gap originating at said flange and extending from said flange to the lower portion of said rigid section, said gap being characterized by an angle of about 0°–2.0° which is defined by each said side wall of said pliant section and said rigid section.

7. A cartridge container into or from which a viscous fluid consisting of ink is supplied or removed, comprising:

a lower half container section made of a rigid material having an upper opening defined by an edge portion;

an upper half container section made of a pliant sheet material having a lower opening defined by an edge portion which is bonded to the edge portion of said rigid section, said edge portion of said rigid section being constructed as a flange to which the edge portion of said pliant section is linearly bonded to seal the cartridge container; and a spout disposed externally at a lower portion of said rigid section through which the viscous fluid is supplied into and removed from the cartridge container;

wherein said pliant section has a shape and is dimensioned to be foldable into an interior of said rigid section in a reversibly turned-over condition so as to closely oppose an inner wall of said rigid section, said pliant section being substantially entirely folded into said rigid section when the viscous fluid is substantially entirely removed therefrom through said spout, said rigid section and said pliant section having shapes and dimensions such that a space is defined between said rigid section and said pliant section adjacent said spout when said pliant section is substantially entirely folded into said rigid section.

* * * * *